United States Patent [19]

Aiken et al.

[11] Patent Number: 4,741,118

[45] Date of Patent: May 3, 1988

[54] SIGN WITH IMPROVED SCROLLING MECHANISM

[75] Inventors: Robert B. Aiken, Grafton; Dennis M. Bauer, Random Lake; James R. Hogan, Milwaukee, all of Wis.

[73] Assignee: Milwaukee Sign Company, Inc, Grafton, Wis.

[21] Appl. No.: 871,072

[22] Filed: Jun. 5, 1986

[51] Int. Cl.[4] ..... G09F 11/18

[52] U.S. Cl. ..... 40/518; 40/471; 40/466

[58] Field of Search ..... 40/466, 471, 518, 519, 40/470, 467, 483, 522, 523; 242/155 R

[56] References Cited

U.S. PATENT DOCUMENTS

| | | | |
|---|---|---|---|
| 386,189 | 7/1888 | Delany | 40/466 |
| 655,627 | 8/1900 | McGregor | 40/470 |
| 658,375 | 9/1900 | McGregor | 40/470 |
| 880,263 | 2/1908 | Young | 40/466 |
| 1,591,448 | 7/1926 | Waite | 40/518 |
| 1,945,571 | 2/1934 | Samaras et al. | 40/571 |
| 1,965,875 | 7/1934 | Behymer | 40/560 |
| 1,978,556 | 10/1934 | Sturner | 40/466 |
| 2,118,696 | 5/1938 | Bonetti | 40/466 |
| 2,935,806 | 5/1960 | Young | 40/471 |
| 3,780,458 | 12/1973 | Jacoby et al. | 40/571 |

*Primary Examiner*—Robert P. Swiatek
*Assistant Examiner*—J. Hakomaki
*Attorney, Agent, or Firm*—Andrus, Sceales, Starke & Sawall

[57] ABSTRACT

A scrolling sign has a sign face member with windows in which indicia appear. A framework is mounted proximate the interior surface of the sign face member. A pair of shafts are mounted on the framework to contain a plurality of web rolls between which webs containing indicia extend. Guides adjacent the windows guides the web and prevent light leaks. The guides are so formed as to avoid shadows on the sign face member. A drive mechanism simultaneously rotates the shafts. Clutches, interposed between the web rolls and the shafts, are selectively operable to move the webs in one or the other direction across the window to alter the displayed indicia. A constantly applied differential brake is also coupled to said web rolls to maintain tension on the webs and to assist in their movement.

36 Claims, 4 Drawing Sheets

74
69
36
64c
62c
18
58c
74
69
64b
62b
18
58b
122
74
69
4
4
58a
62a
18
3
3
74
66
64a
30
32
60
40
48
46
52
44
50
54
42
28
34

SIGN WITH IMPROVED SCROLLING MECHANISM

The present invention relates to a sign of the type in which indicia, such as pricing and/or other information may be changed by scrolling a web containing same across one or more viewing windows in the sign. The sign is typically of the back lighted type. Such a sign is hollow and has internal lights and one or more translucent sign face panels through which the light shines.

Information about a wide range of products and services are displayed on signs or billboards. It is often necessary to change the information displayed due to competitive factors, seasonal considerations, special promotions, or numerous other reasons.

Motor fuel, such as gasoline, is typical of a product for which information, such as pricing, changes frequently. The price of gasoline is typically advertised to the consumer by signage located on the premises of the service station. The signs are usually close to the road and thus remote from the office or payment booth. They are usually elevated to increase their visibility to passing motorists. Such signs are also usually backlighted for the same reasons, as well as to emphasize brand names and other consumer information. All of these factors raise problems with respect to changing pricing information.

At the present time, changing of pricing or other information is typically done by exchanging placards on the sign, for example one for each digit of the price or for each letter of a word. However, the location and construction of signage, such as gas price signs, often makes this difficult. The rails on which the placards rest cause discoloration and shadows on the face of the sign, lessening the attractiveness of, particularly, backlighted signs. The placards used in such signs are exposed to the weather, leading to difficulty in exchange, movement because of wind, and deterioration. A large inventory of placards must be maintained. As it becomes necessary or desirable to change information frequently, the inability to conveniently change the information creates serious service problems.

These problems have lead to the development and use of electrically changeable signs. In such signs, the numbers or letters are formed from a matrix of incandescent light bulbs, liquid crystal or light emitting diode elements, or magnetic flippers. However, the use of such matrices often lessens or destroys the graphic features or asthetics of the sign. Colors, fonts or other design features of the changeable indicia are usually severely limited.

It is, therefore, the object of the present invention to provide an improved sign in which information displayed by the sign can be easily and conveniently changed from a remote location while at the same time providing a sign having improved aesthetic and appearance considerations over those heretofore available.

This is accomplished by a sign in which one or more webs containing indicia are scrolled past windows in the sign face to change the information. The drive mechanism for the webs may be remotely controlled in a precise manner. The graphic aspects of the webs may be selected to complement or enhance the graphic design of the remaining portions of the sign. The webs are easily replaceable, if desired, to alter color, typestyle, and the like.

It is a more particular object of the present invention to provide a sign of the above described type that is capable of being back lit while at the same time retaining its improved aesthetics and changeable information features.

It is a further object of the present invention to provide a scrolling sign, the operating mechanism of which is light in weight and compact in size thereby to facilitate insertion of the mechanism in existing, as well as new, signage enclosures of the mechanism.

Briefly, the present invention is suitable for use in a hollow sign having a face member with at least one, and typically a plurality of, windows in which pricing or other indicia may appear. A framework is mounted in the sign proximate to the interior surface of the sign face member. A pair of spaced, parallel drive shafts are journalled in the framework. Drive means are provided for simultaneously rotating the shafts. The drive means is typically a motor connected through gearing to the shafts. A plurality of web rolls are mounted on each of the shafts. The shafts rotate relative to the web rolls. A web containing indicia extends between a corresponding pair of web rolls on the spaced shafts. The webs have the indicia arranged in series therealong. The portion of the web between the rolls extends across the interior surface of the windows in the sign face member. Electrically operated clutches selectively couple the web rolls to the associated rotating shaft to wind the web on one web roll, while allowing it to be unwound from the other web roll. The clutches may be operated from a remote location to move the web across the window to display the indicia. A constantly applied, differential braking means is also coupled to the web rolls to maintain tension on the web and to control tension during movement.

The drive shafts are segmented to permit the rolls the webs to be selectively removed and replaced for easy maintenance, to change the colors or font of the web, or to provide a web having different indicia.

The webs can be lead across the window in the sign face by guide means so formed and arranged as to lessen or eliminate shadows or light leaks on the sign face, thereby to provide a highly attractive appearance to the sign.

The invention will be further explained in the following description with the aid of the accompanying drawings.

While the present invention is described in the context of a sign for indicating the price of fuels to motorists, it will be clearly appreciated that the invention is not so limited. The sign of the present invention may be used to provide alphabetical or numeric information about a wide range of goods or services in a plurality of different types of signs.

Figure 1:
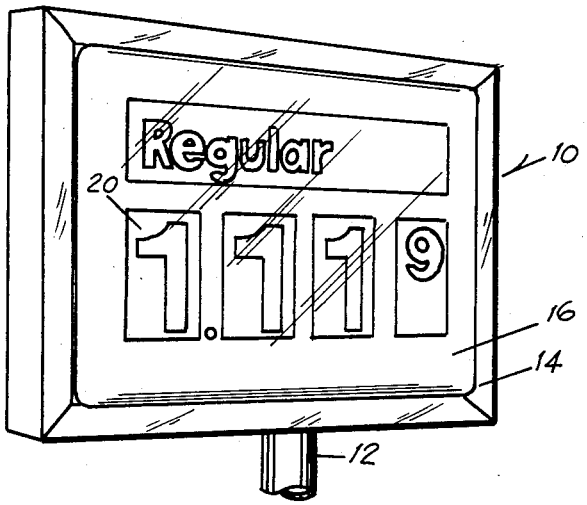
FIG. 1 is a perspective view of the improved scrolling sign of the present invention.
Figure 3:
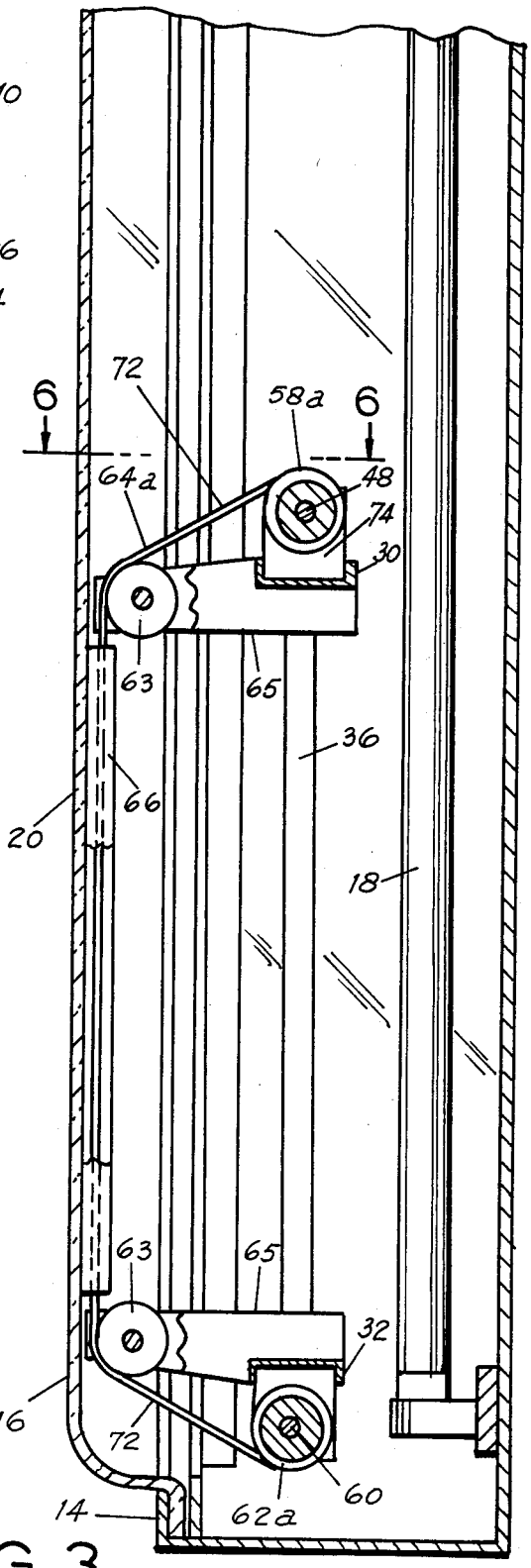
FIG. 3 is a partial cross sectional view taken along the line 3—3 of FIG. 2.

FIG. 1 shows sign 10 used to indicate the price of fuels to motorists. The sign may be elevated for approved visibility by mounting it atop post 12. Sign 10 has peripheral rim 14. One or both faces 16 of the sign may be formed of a translucent material, such as plastic, that is vacuum formed to the bulging configuration shown most clearly in FIG. 3. Lights, such as fluorescent tubes 18 also shown in FIG. 3, are provided in the hollow interior of sign 10 for backlighting the sign through translucent face 16. While FIG. 3 shows a sign 10 with only a single face 16, it will be appreciated that a translucent face 16 may be provided on both sides of sign 10.

The pricing indicia in sign 10 appears in windows 20 in face 16 formed of transparent portions of the sign face. For a commodity, such as gasoline, three or four such windows may typically be provided. The indicia may be changed to alter the displayed price by the scrolling mechanism hereinafter described.

Figure 2:
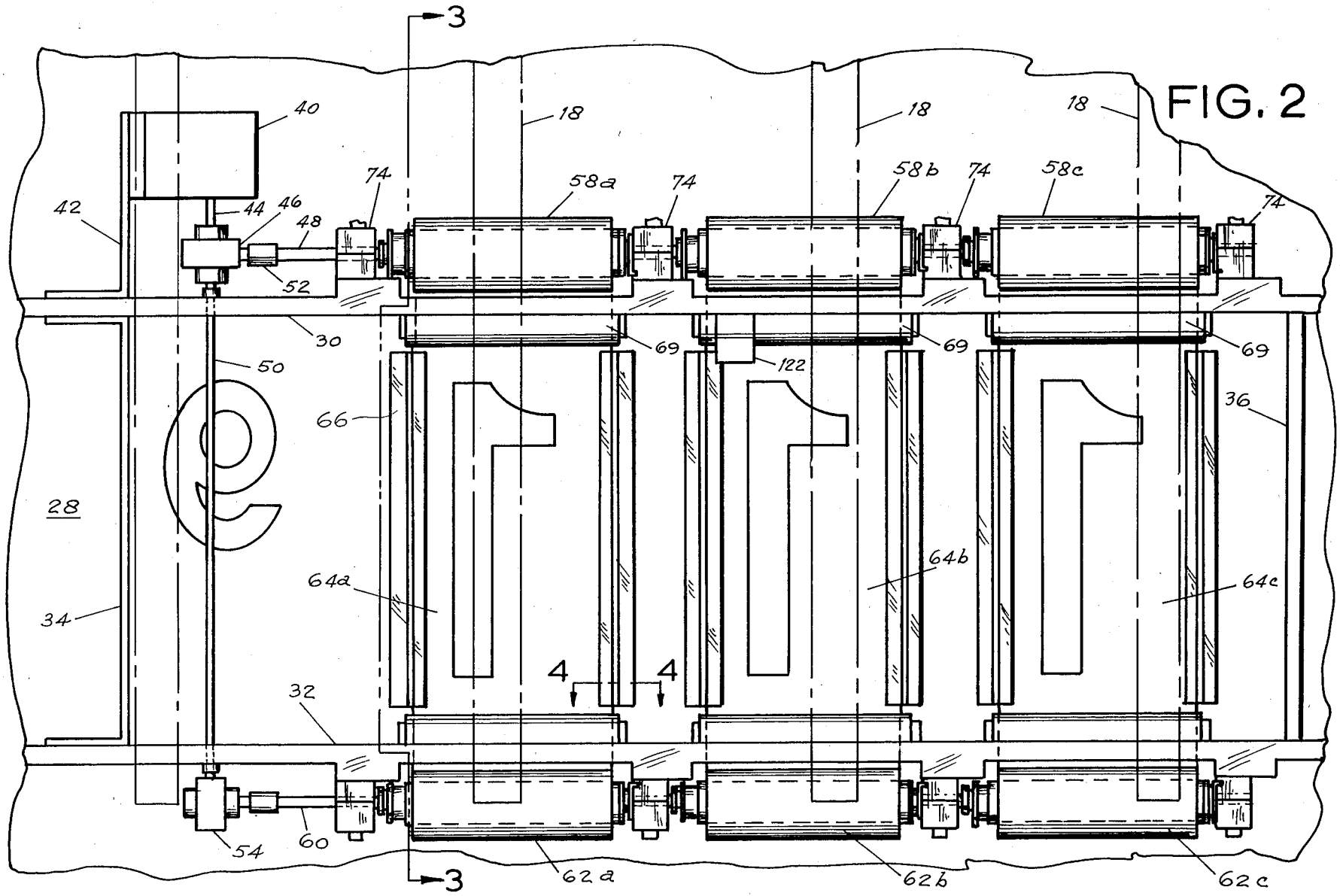
FIG. 2 is a partial cross sectional view taken in the direction opposite from that in which the sign is normally viewed, i.e. the view looks from the inside toward the outside.

As shown in FIG. 2, the scrolling mechanism includes a framework 28 whicn, in the embodiment of the invention shown in the figures, lies generally horizontally. It will be appreciated that, if desired, the framework may also be vertically mounted. Framework 28 has an upper beam 30 and lower beam 32. The ends of beams 30 and 32 are mounted to rim 14. The framework includes spaced vertical members 34 and 36 extending between beams 30 and 32. The rigid framework provided by the beams and members lends reliability to the operation of sign 10.

Motor 40 is mounted on framework 28 as by bracket 42. Motor 40 preferably rotates in a single direction. Output shaft 44 of motor 40 extends to gear box 46. Output shaft 44 extends in the vertical direction. Gearbox 46 is of the right angle type having a pair of output shafts 48 and 50. Horizontally extending output shaft 48 extends through coupling 52 along in upper beam 30. Downwardly extending output shaft 50 extends through a bearing in lower beam 32 to right angle gear box 54. Gear boxes 46 and 54 are preferably of the self-lubricating, enclosed type.

The output shaft 48 of gear box 46 extends horizontally along the top of upper beam 30 to drive a plurality of upper web rolls 58*a, b,* and *c* in a manner hereinafter described. The output shaft 60 of gear box 54 extends horizontally along the bottom of lower beam 32, to drive a plurality of lower web rolls 62*a, b,* and *c,* also in a manner hereinafter described. Shafts 48 and 60 may rotate in the same or opposite directions depending on the winding directions of the webs on the rolls. In the described embodiment of the invention, the construction of gear boxes 46, and 54 are such that upper and lower output shafts 48, 60 rotate in opposite directions.

Webs 64*a, b,* and *c* are wound in opposite directions on upper and lower web rolls 58 and 62, as shown in FIG. 3. As seen from FIGS. 7 and 8, web rolls 58, 62 contain end flanges 57 for retaining and aligning the web. The portions of webs 64 between the rolls appear in windows 20 in face 16 of sign 10. Web 64 extends over an idler roll 63 above and below the window to assist in aligning the web in the window. Idler rolls 63 also provide the spacing between web 64 and the inner surface of face 16 shown in FIGS. 3 and 4. This prevents the web from freezing to the face in cold weather or being scratched by the face. Idler rolls 63 are mounted on brackets 65 fastened to beams 30, 32. The ends of brackets 65 extend beyond the idler rolls to prevent the inner surface of face 16 from striking and scratching the web in the event it is deflected inwardly by wind.

Webs 64 may also be wound in the same direction on rolls 58, 62. This avoids excessive curling of the web due to the different feed directions of the web.

Figure 4:
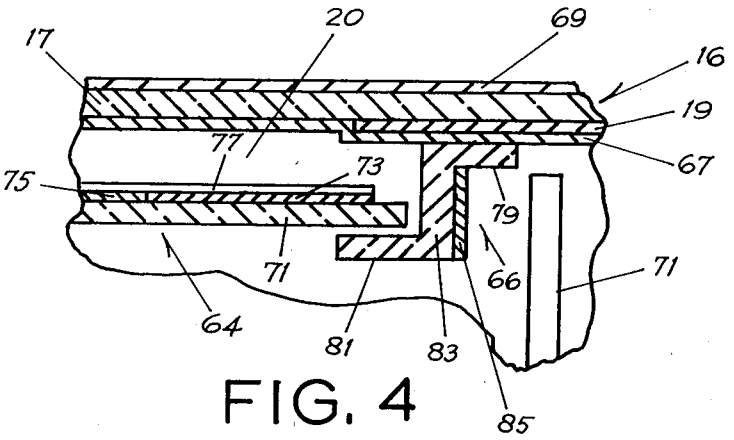
FIG. 4 is a fragmentary cross sectional view taken along the line 4—4 of FIG. 2.
Figure 10:
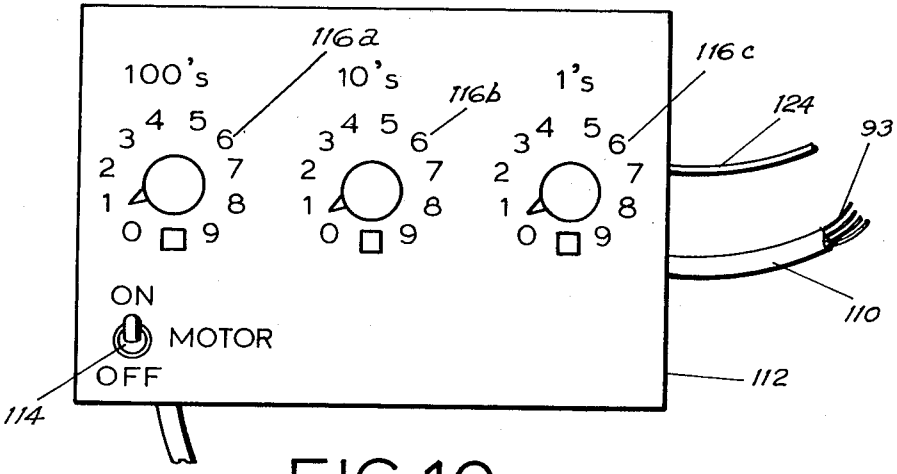
FIG. 10 is a perspective view of a control panel for the scrolling sign of the present invention.

Guides 66 can be provided along either edge of window 20 on the interior of face 16 for guiding the web. Guide 66 is shown in detail in FIG. 4. FIG. 4 shows sign face 16. The face may be formed of a clear plastic base 17 covered by colored translucent coating 19. Coating 19 is not applied in the area forming window 20. A clear protective coating 67 may be applied over coating 19. A protective coating 69 may also be applied to the exterior of sign face 16.

Web 64 is typically formed of a clear base 71 with a translucent colored background coating 73 that is typically the same color as coating 19. The indicia on web 64 are formed by translucent indicia coating 75 of a color that contrasts to that of coating 73. A protective coating 77 may be applied to coatings 73 and 75. Depending on the graphic effect desired, the indicia may be lighter or darker than the background.

As shown in FIG. 4, guide 66 is generally S shaped in configuration having parallel end portions 79 and 81 and normal intermediate portion 83. End portion 79 is fastened to the inner side of sign face 16. Normal portion 83 and end portion 81 embrace web 64 to guide same.

In order to have an aesthetically pleasing sign it is necessary to both avoid light leaks on the face of the sign and to avoid uneven coloring from excessive shadows or duplicate coatings. Thus, light leaks are prevented by the slight overlap of coating 19 on face 16 with coating 73 on web 64. Shadowing is minimized by the small overlap of coatings 19 and 73. Light leaks are also prevented by coating 85 on normal portion 83 of guide 66. Coating 85 may be the same or similar to coatings 19 and 73. Only the edge of coating 85 is projected on the face 16 sign 10 thereby to reduce shadowing. Guides 66, idler rolls 63 and brackets 65 are formed of transparent or translucent material for reducing or eliminating shadowings.

Figure 6:
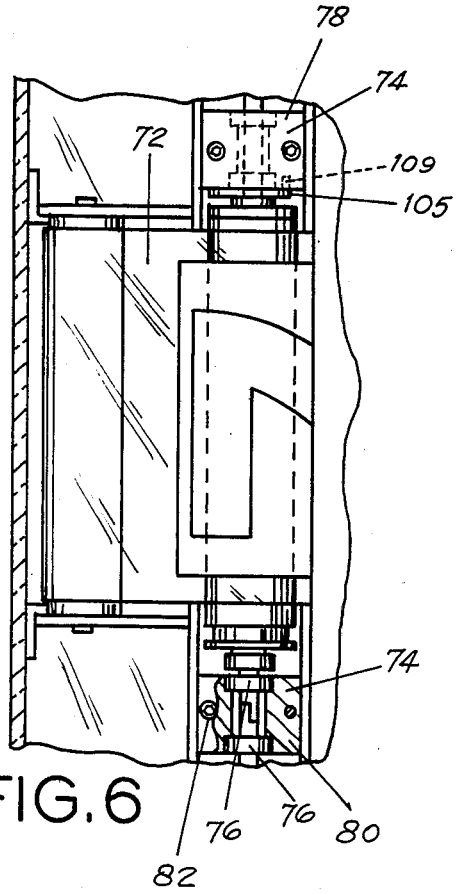
FIG. 6 is a partial top view taken along the line 6—6 of FIG. 3.
Figure 5:
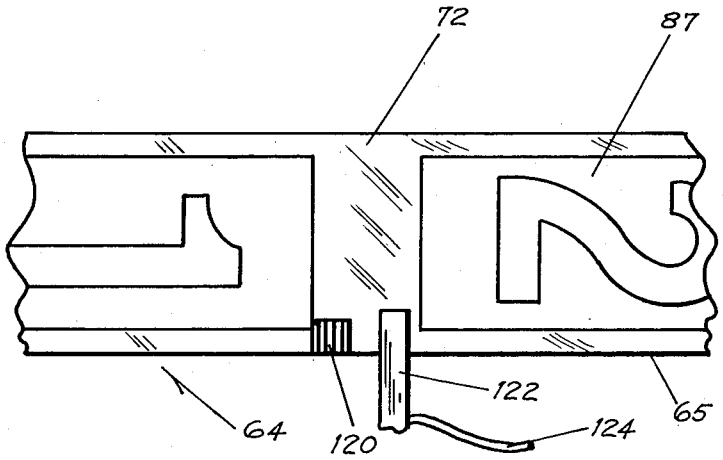
FIG. 5 is a fragmentary view showing a portion of one of the indicia carrying webs of the sign.

As shown most clearly in FIG. 5, each web 64 includes a series of indicia 87, such as numerals. The indicia are separated by transparent portions 72. These portions further avoid shadows in face 16 of sign 10 by appearing between the web rolls and idler rolls 63, as shown in FIGS. 3 and 6 in connection with upper web roll 58*a,* when the indicia appear in window 20. A transparent portion is similarly positioned in connection with lower web roll 62*a.*

The construction of upper and lower output shafts 48 and 60 that drive web rolls 58 and 62 to move webs 64 across windows 20 is generally the same. Only upper output shaft 48 will be described in detail below. Shaft 48 is comprised of a plurality of shaft segments mounted between bearing blocks on beam 30. One such segment is associated with each web roll 58. The segments can be exchanged to permit easy replacement of one or more of webs 64 in the scrolling mechanism.

Figure 7:
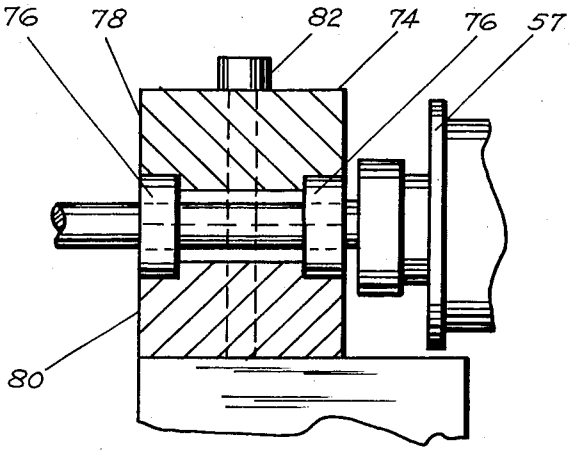
FIG. 7 is a detailed view showing a bearing assembly suitable for use in the sign of the present invention.

Specifically, bearing blocks 74 are provided at each end of web rolls 58 to receive output shaft 48, as shown in FIGS. 2 and 6 and in detail in FIG. 7. Bearing brackets 74 contain a sleeve bearing 76 of plastic or other material at either end thereof. Bearings 76 are retained by upper and lower caps 78 and 80 that are held together by bolts 82. Lower bearing cap 80 is mounted on beam 30. Upper bearing cap 78 is removable when bolts 82 are loosened.

Figure 9:
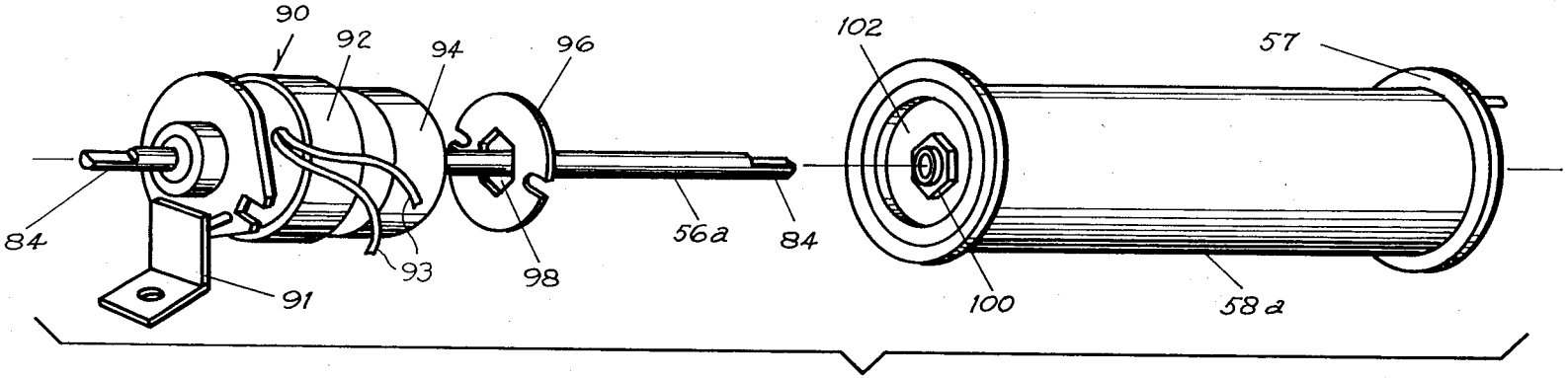
FIG. 9 is a further exploded view of the roll.
Figure 8:
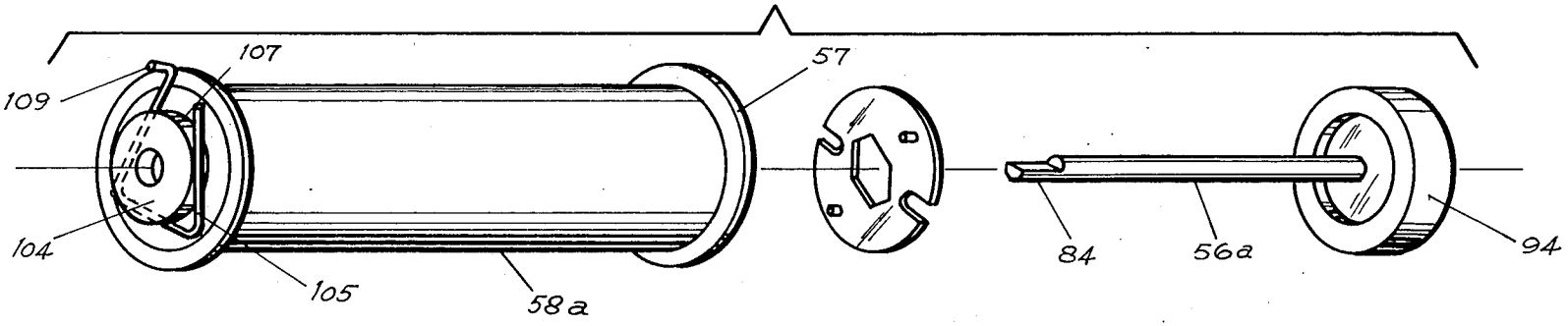
FIG. 8 is an exploded view of a roll for the indicia carrying web showing a clutch means and showing a differential braking means for the web roll.

The segments of output shaft 56 may be joined together by the split shaft configuration shown most clearly in FIGS. 6, 8, and 9. FIG. 8 shows a shaft segment **56*a* associated with web roll 58*a*. At the end of the shaft, a semi-circular portion of the shaft is removed leaving semi-circular portion 84. Semi-circular portion 84 mates with the corresponding semi-circular portion of an adjacent shaft segment, as shown in FIG. 6 so that all of the segments of output shaft 56 are drivingly connected together. There is a minimum of axial movement among the segments of shaft 56 so that the segments are maintained in the coupled state in bearing blocks 74 in the manner shown in FIGS. 6 and 8. Segments can be removed by loosening bolts 82, removing the bearing cap 78, and lifting out the shaft segment and associated web roll and web. A similar procedure is performed in connection with lower output shaft 60**. Replacement shaft segments, webs, and web rolls are installed by reversing the process.

Web rolls 58 are coupled to shaft 56 by selectively engageable clutches 90 shown in FIG. 9, that are preferably electrically operated. Each clutch 90 includes a low voltage field coil 92 that is mounted to upper beam 30 by bracket 91 to surround shaft 56 and is selectively energized from wires 93. A rotor 94 is fixed on shaft 56 in proximity to field coil 92 and is magnetized by the coil, when energized. Armature 96 has a central opening 98 of square or hexagonal shape that fits on a correspondingly shaped boss 100 of core 102 of web roll **58*a*. As seen in FIGS. 2 and 7, the clutch mechanisms basically fits within web rolls 58 and has a diameter no larger than the web rolls, thereby to provide a compact design to the scrolling mechanism that lessens or prevents shadows on sign face 16**.

When rotor 94 is magnetized by field coil 92, armature 96 is applied to the face of rotor 94 to couple web roll **58*a* to shaft 56*a* so that the latter rotates the former. When field coil 92 is deenergized, driving engagement of armature 96 with rotor 94 is lost and shaft 56*a* does not drive core 102**. A clutch suitable for use in the scrolling sign of the present invention is that manufactured and sold by Warner Electric Brake & Clutch Co. of South Beloit, Ill. under the designation SF-120.

To provide a drag or retarding braking action on web roll **58*a*, so as to maintain tension on the web, braking means are provided. For this purpose, a spring clip 105 compressively engages collar 104 on the end of each of the web rolls, such as web roll 58*a*. Collar 104 may contain groove 107 for this purpose. Spring clip 105 may comprise a piece of spring wire bent in the shape shown in FIG. 8. The shape comprises a generally triangular configuration having an open corner. An end 109 of spring clip 105 adjacent the open corner fits in a corresponding hole in an adjacent bearing bracket 74 to anchor the clip, as shown in FIG. 6. The spring clips 105 on the upper and lower web rolls provide tension on web 64 at all times. However, the spring clips provide a differential braking action that is highly advantageous in the scrolling sign of the present invention. Specifically the braking action is such that spring clip 105** provides a greater amount of braking or retarding action when the web is being unwound from a web roll than when it is being rewound onto the web roll.

In the orientation shown in FIG. 8, web roll **58*a* rotates in the counterclockwise direction when the web is being unwound and in the clockwise direction when being rewound. Spring clip 105 provides a greater amount of braking action in the counterclockwise direction because the collar 104 is, in effect, attempting to wrap the clip around the collar. Spring clip 105 provides a lower amount of braking action in the clockwise direction because collar 104 is rotating in a manner tending to open the spring clip. Depending on the exact configuration of spring clip 105 and collar 104, the ratio between unwinding and rewinding braking action may typically be 3:1 to 5:1. The differential braking action permits use of a smaller motor 40 than would otherwise be required if both brakes applied full braking action in both directions. When clutch 90** is deenergized the braking action on the web is greater than the momentum or inertia of the web and rolls to prevent coasting and insure accurate positioning of the web.

By maintaining tension on the web at all times, accurate positioning of the indicia in window 20 is obtained, while avoiding contact between the web and sign face and avoiding light leaks due to improper positioning or movement. The increased tension during unwinding insures evenness in the movement of the web. In the static condition, the braking action on both web rolls insures that the indicia is maintained in the proper position in the window.

As noted above, the construction of lower output shaft 60, and web rolls 62 resembles that of the upper output shaft and web rolls, described in detail.

The compact construction of the scrolling mechanism facilitates its use with a wide variety of signs and permits retrofitting of existing signs. It also eliminates or reduces shadowing on the face of the sign.

Wires 93 from the various clutch field coils 92 in scrolling sign 10 may be lead via cable 110 to an appropriate control panel 112, shown in FIG. 11 and located in the service station office. Control panel 112 may contain on-off switch 114 for motor 40. It also contains switches **116*a*, 116*b*, and 116*c* that control movement of webs 64*a*, 64*b*, and 64*c*, respectively in sign 10. Switches 116 may, for example, have eleven positions: ten numeral positions and a blank position. In an embodiment of sign 10, such as that shown in FIG. 1 indicating the price of a product in dollars, the switches may be labeled to indicate 100's, 10's and 1's. Web 64 may be provided with appropriate indexing or coding marks 120, shown in FIG. 5, that coact with optical scanning means 122 on upper beam 30 having leads 124. The coding mark 120 can, for example, be a bar code so that scanner 122 obtains and provides a signal indicative of the particular numerical indicium as well as an up limit-down limit signal indicating that the indicium is fully within window 20. Leads 124 are connected to control panel 112. A microprocessor or other suitable control device may be provided in panel 112 to control clutches 90. If desired the control device can control motor 40, eliminating the need for switch 114. Or, a simple indexing mark may be provided that indicates only the position of the web and a jog-type control used to step the desired indicium into window 20** by watching the movement of the web in the sign.

To operate scrolling sign 10, motor 40 is energized, as by switch 114, to simultaneously rotate upper and lower output shafts 56 and 60. As noted above, output shafts 56 and 60 may rotate in opposite directions. Specifically, output shafts 56 and 60 always rotate in a direction to wind-up web 64 on the associated web roll. For the configuration of the invention shown in FIG. 3, upper output shaft 56 rotates in the clockwise direction and lower output shaft 60 rotates in the counterclockwise direction. If, for example, it is desired to increase the displayed price from the $1.11 9/10 to a price of $1.21 9/10, switch **116*b* is moved to the numeral "2". This energizes the field coil 92 of the clutch 90 associated with web roll 62*b*, causing lower output shaft 60 to rotate the roll. The clutch 90 associated with web roll 58*b*** is not energized. The control of the clutches is such that clutches connected to rolls for the same web cannot be simultaneously engaged.

Web **64*b* is wound on web roll 62*b* and moved downwardly past window 20 until the numeral "2" appears in the associated window 20. The price displayed is thus increased to $1.21 9/10. Brake 105 provides a drag on web roll 58*b* as web 64*b* is unwound from that web roll. This drag or retarding action maintains tension on the web during movement to insure the indicium is properly displayed in window 20 and to prevent overshoot. As noted above, brake 105 on web roll 62*b* is also applied but the drag is less than that of brake 105 associated with web roll 58*b*. This reduces the power required from motor 40 while at the same time maintaining tension control on the web. Brakes 105 on web rolls 58*a* and 58*b*** also prevent movement of the web rolls when the clutches are not engaged.

Web **64*b* may be moved in the other direction to alter the price display by moving switch 116*b*, for example, to the numeral "0". This energizes the field coil 92 of the clutch 90 associated with web roll 58*b*, causing upper output shaft 56 to rotate web roll 58*b* in the clockwise direction. The corresponding clutch on web roll 62*b* is deenergized. This causes web 64*b* to move upwardly past window 20. The brake 105 on web roll 62*b*** produces a drag on the web.

In the event both faces 16 of sign 10 contain display windows, the apparatus described above and shown in the drawing would be duplicated for the second face of sign 10.

Various modes of carrying out the invention are contemplated as being within the scope of the following claims particularly pointing out and distinctly claiming the subject matter which is regarded as the invention.

I claim:

1. An improved scrolling sign comprising:

a sign face member having at least one window in which indicia may appear;

a framework mounted proximate one side of said sign face member;

a pair of spaced, parallel shafts journalled in said framework;

drive means for rotating said shafts;

at least one web roll mounted on each of said shafts such that said shafts can rotate relative to said web rolls;

a web containing indicia extending between said web rolls for being unwound and rewound on said rolls, said web having indicia arranged in series therealong, said web extending across said window on said one side of said sign face member;

clutch means interposed between each of said web rolls and the shaft on which same is mounted, said clutch means selectively coupling one or the other of said web rolls to the associated shaft for moving said web across said window to selectively display said indicia by unwinding and rewinding said web on said rolls; and constantly applied differential braking means, said braking means being coupled to each of said web rolls for applying tension to, and maintaining tension on, said web, said braking means applying a greater braking action to the web roll from which said web is being unwound than to the web roll on which said web is being rewound.

2. The scrolling sign according to claim 1 wherein said sign face member includes a plurality of windows and wherein said scrolling sign includes a plurality of web rolls and webs to provide one web for each of said windows in which selectively displayed indicia is desired.

3. The scrolling sign according to claim 2 wherein said shafts are journalled in said framework at a plurality of bearings along said shafts.

4. The scrolling sign according to claim 3 wherein said shafts are further defined as having removable segments on which said web rolls are mounted.

5. The scrolling sign according to claim 4 wherein said web rolls are mounted at spaced intervals along said shafts and wherein said bearings are positioned intermediate said web rolls.

6. The scrolling sign according to claim 4 wherein said segmentation of said shafts occurs within said bearings.

7. The scrolling sign according to claim 5 wherein said bearings may be disassembled to permit removal and replacement of one of said shaft segments and web rolls.

8. The scrolling sign according to claim 1 further including idler means along the path of movement of said web, said idler means being fixed to said frame work and having a predetermined fixed relationship with respect to said window and sign face for guiding said web across said window.

9. The scrolling sign according to claim 8 wherein said idler means are further defined as spacing said web from the inner surface of said sign face member.

10. The scrolling sign according to claim 1 further including bracket means mounted on said framework and extending toward said sign face member for limiting deflection of said sign face.

11. The scrolling sign according to claim 8 further including bracket means mounted on said framework and extending toward said sign face member for limiting deflection of said sign face, said idler means being mounted on said bracket means.

12. The scrolling sign according to claim 11 wherein said idler means and brackets are formed of light transmitting material.

13. The scrolling sign according to claim 1 wherein said sign face member has guide means mounted on said one side of said sign face member for positioning said web in said window.

14. The scrolling sign according to claim 13 wherein said guide means is formed of light transmitting material.

15. The scrolling sign according to claim 14 wherein said guide means has a guide along each side of said web, each of said guides having a generally S shape with parallel end portions and a normal intermediate portion, one of said end portions being affixed to the one side of said sign face member, said other end portion and said intermediate portion embracing said web, said intermediate portion having reduced light transmission properties for reducing light leaks in said sign.

16. The scrolling sign according to claim 1 wherein said web has portions with light transmission properties corresponding to those of said sign face member along the edges of the web overlapping with the edges of said window for reducing light leaks in said sign.

17. The scrolling sign according to claim 1 wherein said web has translucent portions intermediate said serially arranged indicia positionable adjacent and said window when an indicia is in said window.

18. The scrolling sign according to claim 1 wherein said clutch means comprise electric clutch means.

19. The scrolling sign according to claim 18 wherein said clutch means is further defined as located within said web rolls.

20. The scrolling sign according to claim 1 wherein said braking means comprises a bent spring wire anchored at one end, said wire being bent in a generally triangular configuration having an open corner, said bent spring wire compressively engaging said web roll within said triangular configuration, said bent spring wire providing increased braking action in one direction of rotation by the tendency of the web roll to wrap said wire around said roll when rotating in said one direction.

21. The scrolling sign according to claim 1 wherein said drive means includes a single drive motor having power transmission means for coupling same to said shafts.

22. The scrolling sign according to claim 1 wherein said drive means simultaneously rotates said shafts.

23. The scrolling sign according to claim 1 wherein said framework has a pair of spaced frame members and wherein said shafts run parallel to said frame members and are journalled thereon.

24. The scrolling sign according to claim 1 wherein said sign has a plurality of sign face members and wherein said scrolling sign further includes a plurality of the elements recited in claim 1 for displaying indicia in the window of each of said sign face members.

25. A scrolling mechanism for a sign with a sign face member having at least one window in which indicia may appear, said mechanism comprising:

a framework mountable proximate one side of said sign face member;

a pair of parallel shafts journalled in said framework;

drive means for rotating said shafts;

at least one web roll mounted on each of said shafts, such that said shafts can rotate relative to said web rolls;

a web containing indicia extending between said web rolls for being wound on said rolls, said web having indicia arranged in series therealong;

clutch means interposed between each of said web rolls and the shaft on which same is mounted, said clutch means selectively coupling one or the other of said web rolls to the associated shaft for moving said web by unwinding and rewinding said web on said rolls; and constantly applied differential braking means, said braking means being coupled to each of said web rolls for applying tension to, and maintaining tension on, said web, said braking means applying a greater braking action to the web roll from which said web is being unwound than to the web roll on which web is being rewound.

26. The mechanism according to claim 25 wherein said shafts are further defined as having removable segments on which said web rolls are mounted.

27. The mechanism according to claim 25 further including idler means along the path of movement of said web for guiding said web across said window.

28. The mechanism according to claim 25 including guide means for said web mountable on the one side of said sign face member.

29. The mechanism according to claim 28 said guide means is formed of light transmitting material.

30. The mechanism according to claim 28 wherein said guide means has a guide along each side of said web, each of said guides having a generally S shape with parallel end portions and a normal intermediate portion, one of said end portions being affixable to the one side of said sign face member, said other end portion and said intermediate portion embracing said web, said intermediate portion having reduced light transmission properties for reducing light leaks in said sign.

31. The mechanism according to claim 25 wherein said braking means comprise a bent spring wire anchored at one end, said wire being bent in a generally triangular configuration having an open corner, said bent spring wire compressively engaging said web roll within said triangular configuration, said bent spring wire providing increased braking action in one direction of rotation by the tendency of the web roll to wrap said wire around said roll when rotating in said one direction.

32. In a scrolling sign having a sign face member with a window in which indicia may appear, a pair of rotatable web rolls with a web containing serial indicia wound thereon and extending therebetween and across said window for selectively displaying an indicium in the window, the improvement comprising:

constantly applied differential braking means, said braking means being coupled to said web rolls for applying tension to said web, said braking means applying greater braking action to the web roll from which said web is being unwound than to the web roll on which said web is being rewound.

33. The improvement according to claim 32 wherein said braking means comprise a bent spring wire anchored at one end, said wire being bent in a generally triangular configuration having an open corner, said bent spring wire compressively engaging said web roll within said triangular configuration, said bent spring wire providing increased braking action in one direction of rotation by the tendency of the web roll to wrap said wire around said roll when rotating in said one direction.

34. The improvement according to claim 1 wherein said braking means comprises a bent spring wire anchored at one end and compressively engaging said web roll, said bent spring wire being so formed as to provide increased braking action in one direction of rotation by the tendency of the web roll to wrap said wire around said web roll when rotating in said one direction.

35. The improvement according to claim 25, wherein said braking means comprises a bent spring wire anchored at one end and compressively engaging said web roll, said bent spring wire being so formed as to provide increased braking action in one direction of rotation by the tendency of the web roll to wrap said wire around said web roll when rotating in said one direction.

36. The improvement according to claim 32 wherein said braking means comprises a bent spring wire anchored at one end and compressively engaging said web roll, said bent spring wire being so formed as to provide increased braking action in one direction of rotation by the tendency of the web roll to wrap said wire around said web roll when rotating in said one direction.

* * * * *